US008523010B2

(12) United States Patent
Mompel et al.

(10) Patent No.: US 8,523,010 B2
(45) Date of Patent: Sep. 3, 2013

(54) BISTABLE COVER ASSEMBLIES

(75) Inventors: Josep Ortiz Mompel, Barcelona (ES); Ismael Chanclon Fernandez, Barcelona (ES); Eduardo Martin Orue, Sabadell (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 128 days.

(21) Appl. No.: 13/149,386

(22) Filed: May 31, 2011

(65) Prior Publication Data

US 2012/0305583 A1 Dec. 6, 2012

(51) Int. Cl.

| | |
|---|---|
| ***B65D 43/14*** | (2006.01) |
| ***B65D 43/18*** | (2006.01) |
| ***B65D 43/22*** | (2006.01) |
| ***B65D 43/24*** | (2006.01) |
| ***B65D 51/04*** | (2006.01) |

(52) U.S. Cl.
USPC ..... 220/827; 220/810; 220/823; 220/824; 220/830; 220/831; 220/833

(58) Field of Classification Search
USPC ..... 220/810, 820, 823, 824, 827, 830, 220/831, 833; 400/690.4
See application file for complete search history.

(56) References Cited

U.S. PATENT DOCUMENTS

| | | | | |
|---|---|---|---|---|
| 3,905,462 | A * | 9/1975 | Nowak | 400/690.4 |
| 4,848,941 | A | 7/1989 | Imaseki | |
| 5,634,730 | A | 6/1997 | Bobry | |
| 6,105,953 | A | 8/2000 | Komuro | |
| 7,451,888 | B2 * | 11/2008 | Tanaka | 220/263 |
| 7,455,397 | B2 | 11/2008 | Sakai et al. | |
| 2006/0266756 | A1 * | 11/2006 | Okada et al. | 220/830 |

* cited by examiner

*Primary Examiner* — Anthony Stashick
*Assistant Examiner* — Madison L Poos

(57) ABSTRACT

In one example, a bistable cover assembly includes a cover, a base, an intermediate part; and pre-tensioned spring, the spring being attached to the base and the intermediate part such that the spring biases the intermediate part into two stable positions, the cover interfacing with the intermediate part and being closed in a first of the two stable positions and open in a second of the two stable positions. A method for assembling a cover assembly is also described.

16 Claims, 8 Drawing Sheets

BISTABLE COVER ASSEMBLIES

BACKGROUND

Some hinged covers, due to geometry and kinematics, use a pre-tensioned spring to keep the cover in an open and/or closed position. The pre-tensioned spring is deflected to produce mechanical force throughout the motion of the cover and to maintain the position of the hinged cover. However, the use of a pre-tensioned spring can have a number of disadvantages. During assembly, the spring is pre-tensioned by deflecting the spring. The force in the spring is maintained while the spring is connected to the various components of the device. Before it is secured to the device, the spring can be suddenly released from its pre-tensioned state. This sudden release of the spring can result in damage to surrounding components, catapulting of the spring into the air, and injury to technicians. After the cover is assembled, the pre-tensioned spring can complicate maintenance procedures. The cover may need to be removed for repair, replacement, or to access other components. Removing the cover can involve removing the fasteners holding the tensioned spring. This can result in the sudden and uncontrolled release of the spring energy. Further, the reassembly of the cover involves pre-tensioning the spring, which can be a difficult and dangerous task for the technicians.

BRIEF DESCRIPTION OF THE DRAWINGS

The accompanying drawings illustrate various examples of the principles described herein and are a part of the specification. The illustrated examples are merely examples and do not limit the scope of the claims.

Throughout the drawings, identical reference numbers designate similar, but not necessarily identical, elements.

DETAILED DESCRIPTION

Figure 1:
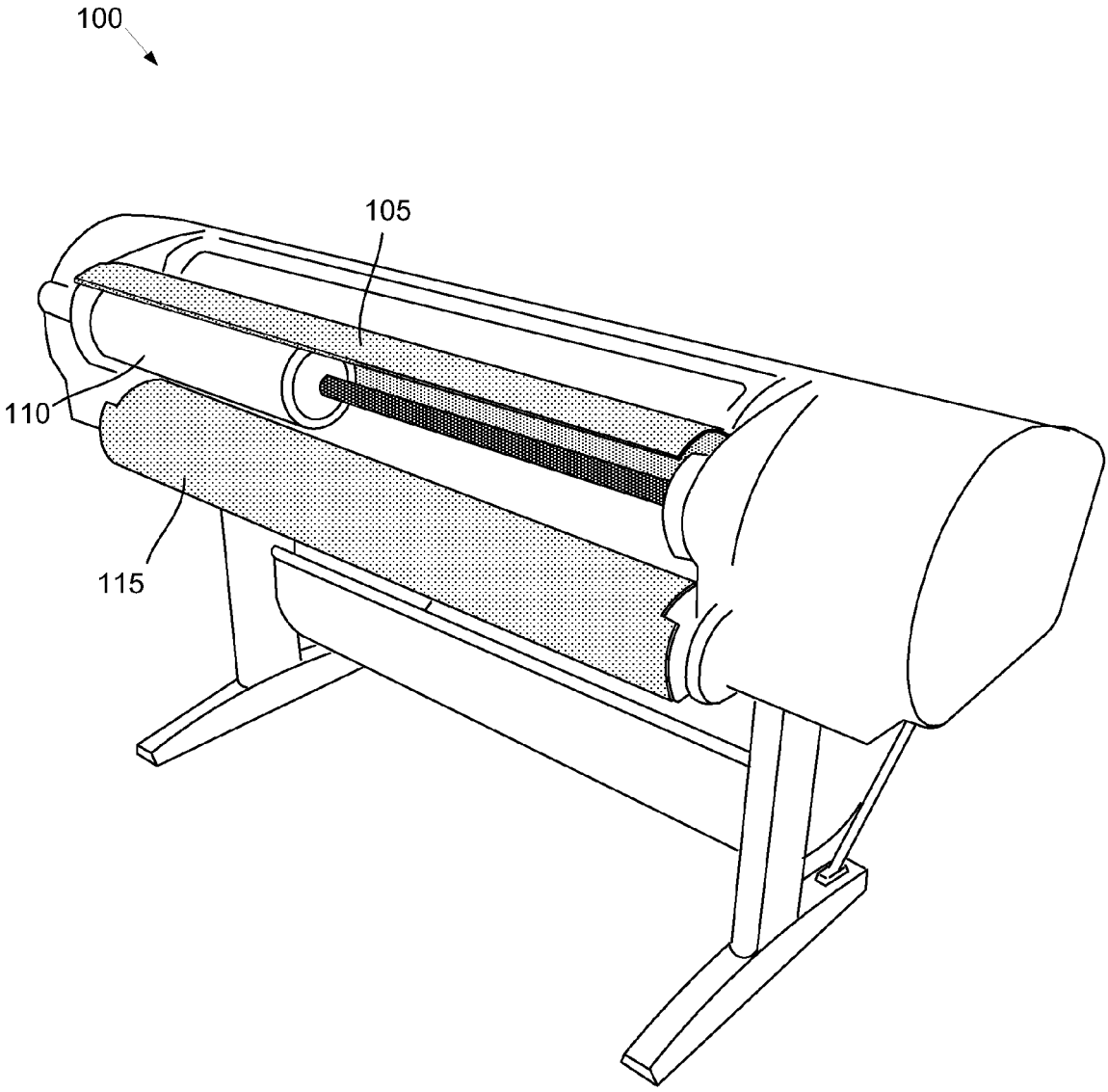
FIG. 1 is a diagram of an illustrative printer with bistable covers that utilize pre-tensioned springs to secure the covers in both an open and closed state, according to one example of principles described herein.

Pre-tensioned springs are useful in applying consistent forces within mechanisms. For example, pre-tensioned springs can be used to counteract gravitational forces or to bias moving mechanisms toward desired positions. One application of pre-tensioned springs is in covers. Covers typically have two positions, an open position that exposes the opening or component and a closed position that conceals the opening or component. In many cases it is desirable for the covers to be mechanically stable in both the open and closed positions. For example, having a stable open position allows a user to access the component or opening without concern that the cover will undesirably close. Similarly, having a stable closed position ensures that the cover will remain closed and protect the enclosed part or opening.

However, the handling, assembly, and disassembly of pre-tensioned springs can be both difficult and hazardous. Pre-tensioned springs can store a significant amount of energy. If the mechanical constraints on a pre-tensioned spring are suddenly released, the pre-tension spring can violently revert to its original neutral configuration. This can result in damage or injury to the spring's surroundings.

Some hinged covers, due to the geometry and kinematics, use a pre-tensioned spring to keep the cover in an open and/or closed position. The pre-tensioned spring is deflected to produce force throughout the motion of the cover. The use of a pre-tensioned spring provides mechanical force to maintain the position of the hinged cover. Where the cover is relatively large or heavy, the spring may be very stiff and store a significant amount of energy in its pre-tensioned state.

The use of a pre-tensioned spring in a hinged cover can have a number of disadvantages. During assembly, the spring is pre-tensioned by applying a compressive or tensile force. This compressive or tensile force is maintained while the spring is connected to the various components of the device. Before it is secured to the device, the spring can be suddenly released from its pre-tensioned state. This sudden release of the spring can result in damage to surrounding components, flying of the spring, or injury to technicians. After the cover is assembled, the pre-tensioned spring can complicate maintenance procedures. The cover may need to be removed for repair or replacement or to access other components. When the cover is removed, the pre-tensioned spring can be suddenly released. Further, the reassembly of the cover involves pre-tensioning the spring, which can be a difficult and dangerous task for the service personnel.

In the following description, for purposes of explanation, numerous specific details are set forth in order to provide a thorough understanding of the present systems and methods. It will be apparent, however, to one skilled in the art that the present apparatus, systems and methods may be practiced without these specific details. Reference in the specification to "an example" or similar language means that a particular feature, structure, or characteristic described in connection with the example is included in at least that one example, but not necessarily in other examples.

As used in the specification and appended claims the term "pre-tensioned" or similar expressions refer to the deflection of a spring prior to installation in a mechanism such that the spring maintains a force throughout the entire range of motion of the mechanism.

FIG. 1 is a diagram of an illustrative printer (100) with bistable covers (105, 115) that utilize pre-tensioned springs to secure the covers in both an open and closed state. The bistable covers (105, 115) are used to enclose rolls of printing substrate (110). The covers (105, 115) are opened to replace the rolls (110) and closed during the printing process to protect the substrate (110) and moving mechanisms. The pre-tensioned springs secure the covers (105, 115) in both the open and closed states. The stable open state allows a user to use both hands to replace the substrate roll (110) without concern that the covers (105, 115) will inadvertently close. The stable closed state ensures that the covers (105, 115) remain in place and protects the substrate (110) during the printing process.

The covers (105, 115) in this example are relatively large and are supported at each end. Relatively strong springs are used at both ends of the covers (105, 115) to provide desired mechanical force.

The printer described above is only one illustrative example of a mechanism that may use bistable covers with pre-tensioned springs. A variety of other devices may use pre-tensioned springs to create bistable covers or doors.

Figure 2:
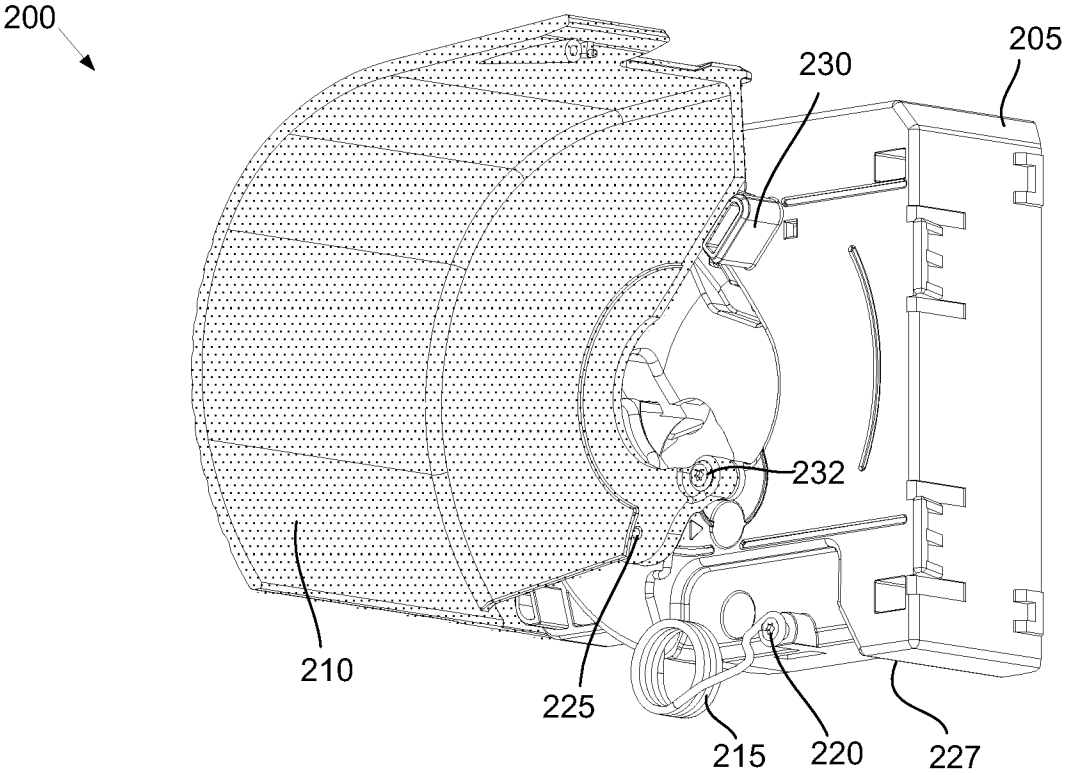
FIG. 2 is a perspective view of a bistable cover with an exposed pre-tensioned spring that attaches directly between a base and the cover, according to one example of principles described herein.

FIG. 2 is a perspective view of a bistable cover assembly (200) that includes a base (205), cover (210), and an exposed spring (215). The cover (210) is attached to the base (205) at a hinge point (232). An exposed spring (215) attaches directly between the base (205) using a screw (220) and the cover (210) using a screw (225). In this example, the exposed spring (215) is a torsional spring.

The spring (215) is pre-tensioned to provide forces to create two stable positions, one at either end of the cover travel. The bistable hinge mechanism is mirrored at both ends of the long cover (210). The spring (215) remains tensioned for all cover positions. Because the cover mass is relatively high, the pre-tension on the spring (215) is high. The torque provided by the spring force biases the cover (210) toward the mechanical stops (227, 230) at either end of the cover travel.

During assembly of the cover mechanism (200), the spring pre-tension can be manually applied and held while the spring (215) is secured in place. This may have a number of disadvantages, including using two technicians during the assembly process: one to pre-tension and position the spring (215) and another to position and tighten the screws. If the spring (215) slipped during the assembly process, the spring's pre-tension could be violently released, potentially causing injury to the technicians or surrounding components.

Similarly, when service technicians work on a deployed printer and replace the cover or remove it to access other components, the spring can suddenly release its preload when one of the spring ends are loosened. After the maintenance is complete, the service technician then reassembles the mechanism, including tensioning the spring and securing it in place. As discussed above, it can be manually challenging to simultaneously apply a preload to the spring, position the spring with respect to the other components, and position/tighten the fasteners on both ends of the spring.

In one example, a solution to improve the serviceability of the roll cover was implemented. This solution called for the technician to carefully release and discard the existing spring. After the maintenance was complete, a new spring that is secured in its pre-tensioned state by a preload bracket is installed by securing one end of the spring to the base and the other end to the cover. The roll cover is then rotated so that the new spring is compressed enough to release the preload bracket. The preload bracket is then discarded. This procedure calls for replacement of a perfectly operational spring with a new spring, only because of the pre-tension.

The illustrative bistable cover assembly (200) shown in FIG. 2, also exposes the pre-tensioned spring (215). The exposed spring (215) can be seen and touched by the user. This can lead to aesthetic, safety and reliability issues.

Figure 3A:
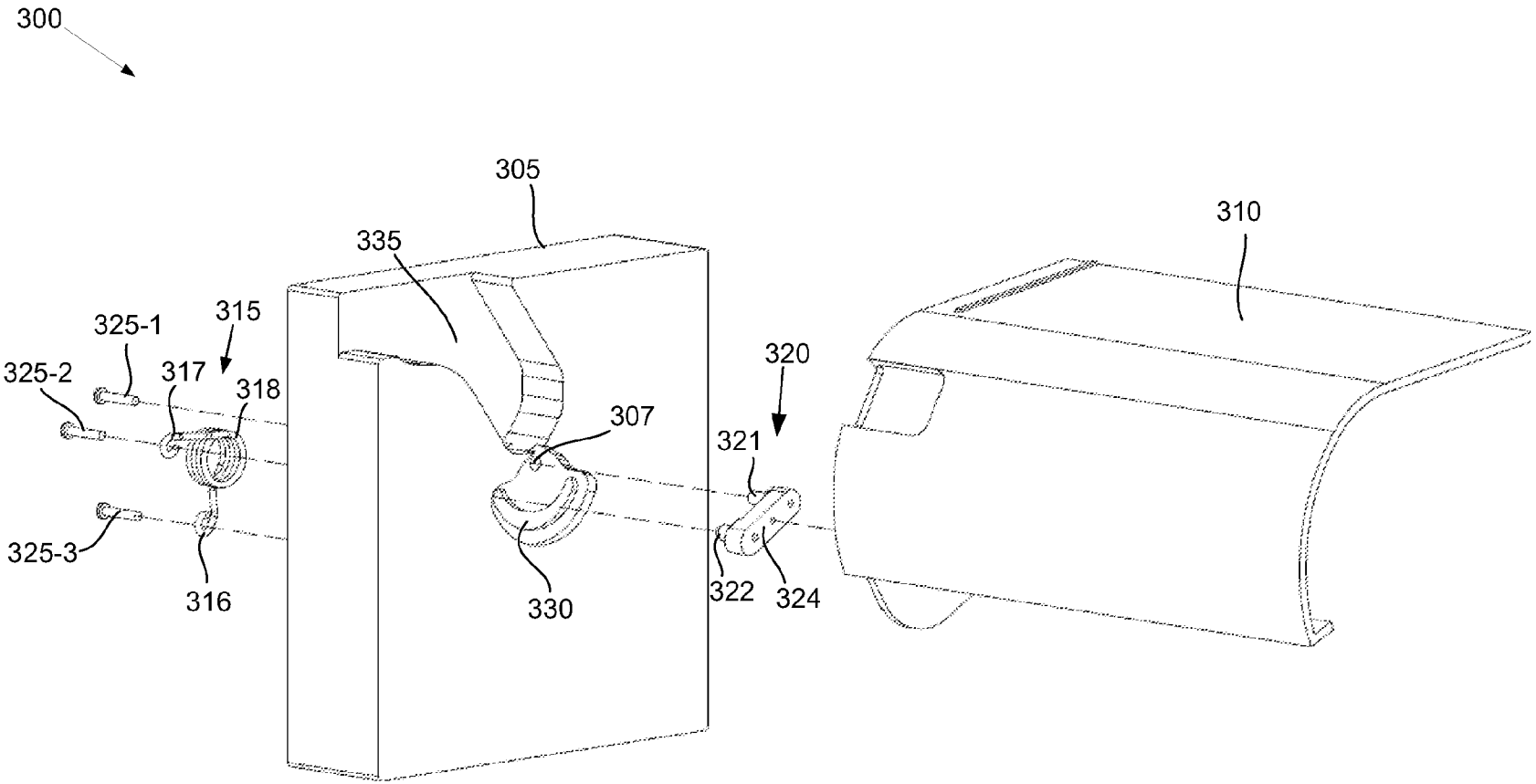
FIGS. 3A and 3B are exploded views of a bistable cover assembly that includes an intermediate part that serves as an interface between a pre-tensioned spring and a cover, according to one example of principles described herein.
Figure 3B:
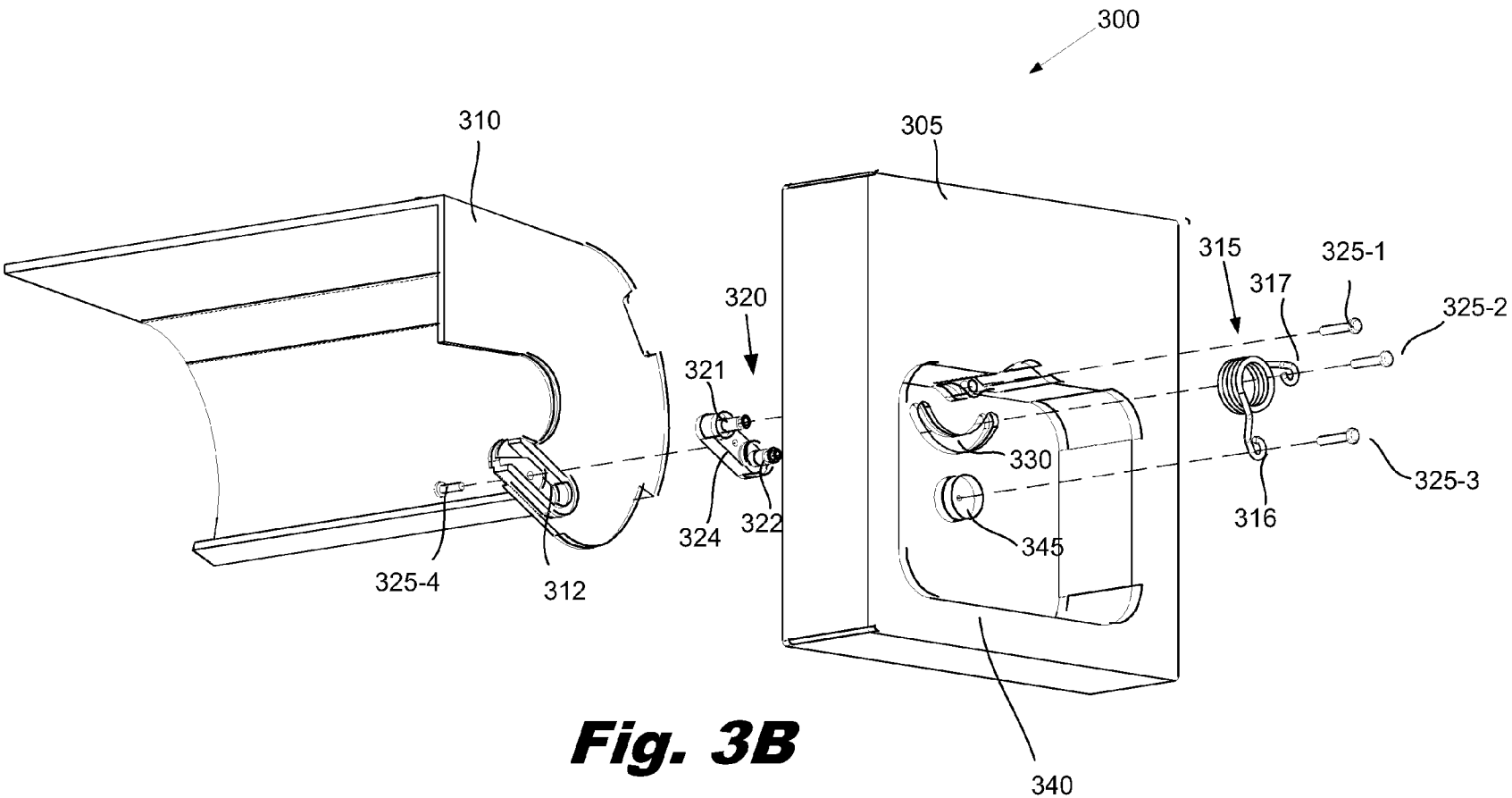

FIGS. 3A and 3B are exploded views of an illustrative bistable cover assembly (300) that includes an intermediate part (320) that serves as an interface between a pre-tensioned spring (315) and a cover (310). Although the components shown in this example are used in conjunction with a printer, the principles described herein are not limited to any specific application and can be applied broadly to a wide variety of spring loaded mechanisms. In this example, the base (305) is a roll support of a printer. The roll support (305) includes a rod cavity (335) and an arc shaped aperture (330). The rod cavity (335) is designed to receive one end of a support rod that passes through the center of a substrate roll. The arc shaped aperture (330) is designed to interface with the intermediate part (320) and limit its range of motion. The roll support (305) also includes a hole (307) that is designed to interface with a pivot post (321) of the intermediate part (320).

The intermediate part (320) includes a body portion (324), a moving post (322) and a pivot post (321). The pivot post (321) is pivotally connected to the hole (307) in the roll support (305) by a fastener (325-1). The moving post (322) on the opposite end of the intermediate part (320) passes through the arc shaped aperture (330) and is connected to a first end (316) of a torsion spring (315) by a second fastener (325-2). The body portion (324) of the intermediate part (320) interfaces with the cover (310) and has a center hole that receives a fastener to hold it in place. The interface between the body portion (324) and the cover (310) is illustrated in more detail in FIG. 3B.

The torsion spring (315) has a coiled portion (318), first end (316) and a second end (317). As discussed above, the second end (317) of the torsion spring (315) is attached to the moving end of the intermediate part (322) by a fastener (325-2). The first end (316) is attached to an anchor point on the base (305) by fastener (325-3). The fasteners (325) may be any of a variety of fastener types that are suitable to secure the components together, including screws, pins or rods.

FIG. 3B is another perspective view of the illustrative bistable cover assembly (300) illustrated in FIG. 3A. This view shows that the base (305) has an interior cavity (340) into which the spring (315) is secured. As discussed above, the first end (316) of the spring (315) is fastened to an anchor point (345) by a fastener (325-3). In this example, the anchor point (345) is a reinforced portion of a wall in the interior cavity (340). The second end (317) of the spring (315) is connected to the moving post (322) of the intermediate part (320) by a fastener (325-2). In this example, the moving post (322) extends through the arc shaped aperture (330). The intermediate part (320) is secured to the base (305) by attaching the pivot post (321) to the base using a fastener (325-1).

In one implementation, the base (305), spring (315), and intermediate part (320) can be pre-assembled in a manufacturing setting to form a hinge assembly. The cover (310) can then be attached on both ends to hinge assemblies. This pre-assembly of the base (305), spring (315) and intermediate part (320) includes pre-tensioning the torsion spring (315), and fastening the three screws (325-1, 325-2, 325-3) into the intermediate part (320) and the base (305) to hold the components together. As discussed above, there are two of these bistable hinge mechanisms, one at either end of the cover (310). In some examples, a door can cover the opening of the interior cavity (340) of the base (305). This entirely encloses the spring (315) and increases the safety and aesthetics of the cover mechanism.

On the main production line, the cover (310) is slipped over the intermediate parts (320) so that an interface feature (312) captures the body (324) of the intermediate part (320). The intermediate parts (320) are secured to the cover using a fastener (325-4). This simplifies the process of attaching the cover to the device. In this example, two fasteners are used, one on either end of the cover (310). The interface feature (312) of the cover (310) allows torque generated by the torsion spring (315) to be transmitted to the cover (310).

The removal of the cover (310) for maintenance or replacement is also simplified. The cover (310) is opened to provide access to the fasteners (325-4) that hold the intermediate part (320) into the interface feature (312). The fasteners (325-4) are removed and cover (310) is slid away from the base (305). Installation of the cover (310) after the maintenance is complete is done by sliding the cover (310) over the intermediate parts (320) so that the body of the intermediate parts engage the interface feature (312) and reinstalling the fasteners (325-4).

Figure 4A:
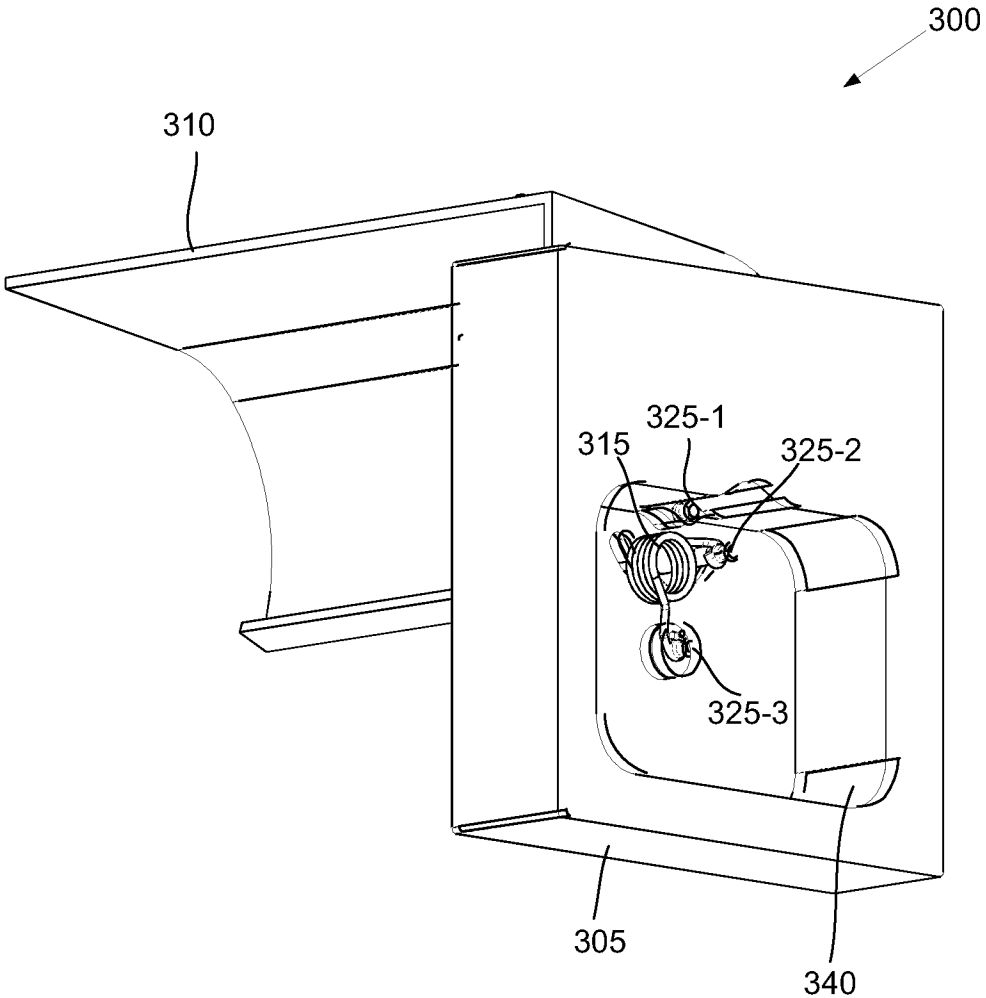
FIGS. 4A-4C are perspective views of a bistable cover assembly, according to one example of principles described herein.
Figure 4B:
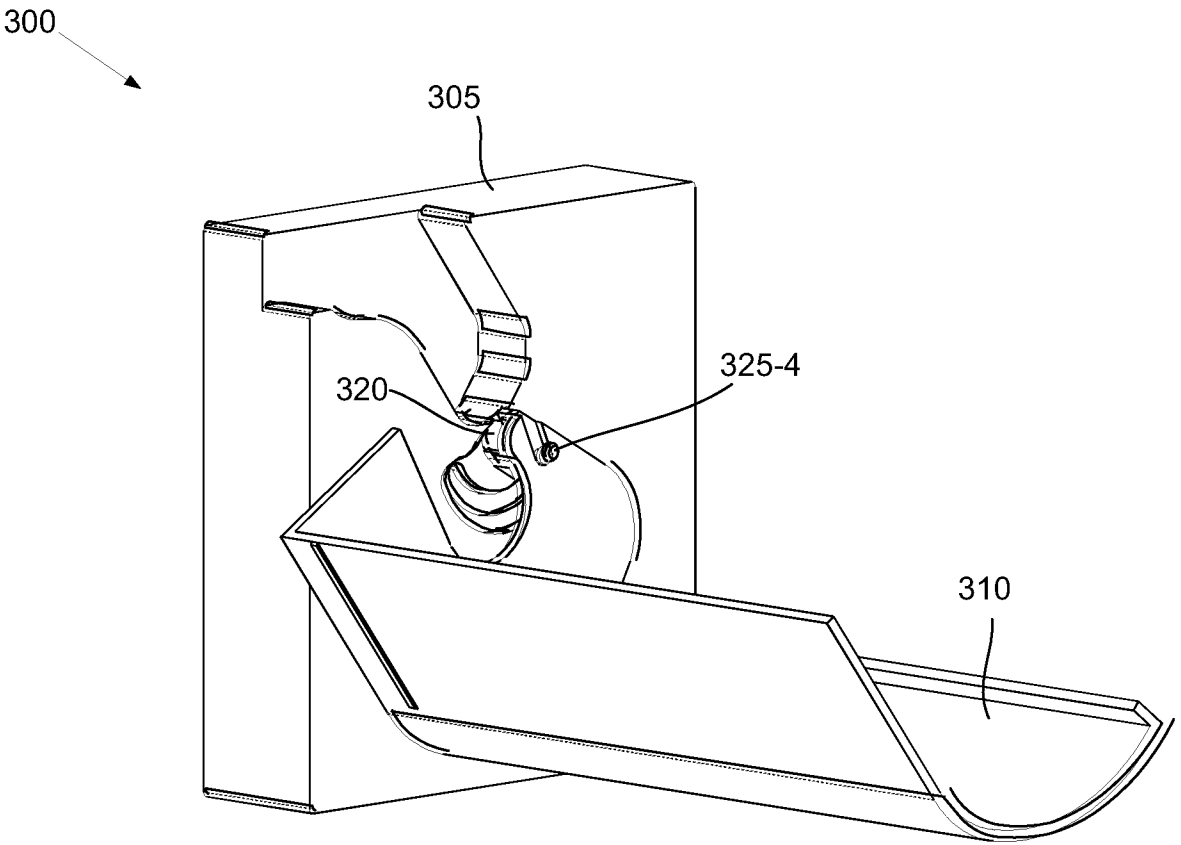
Figure 4C:
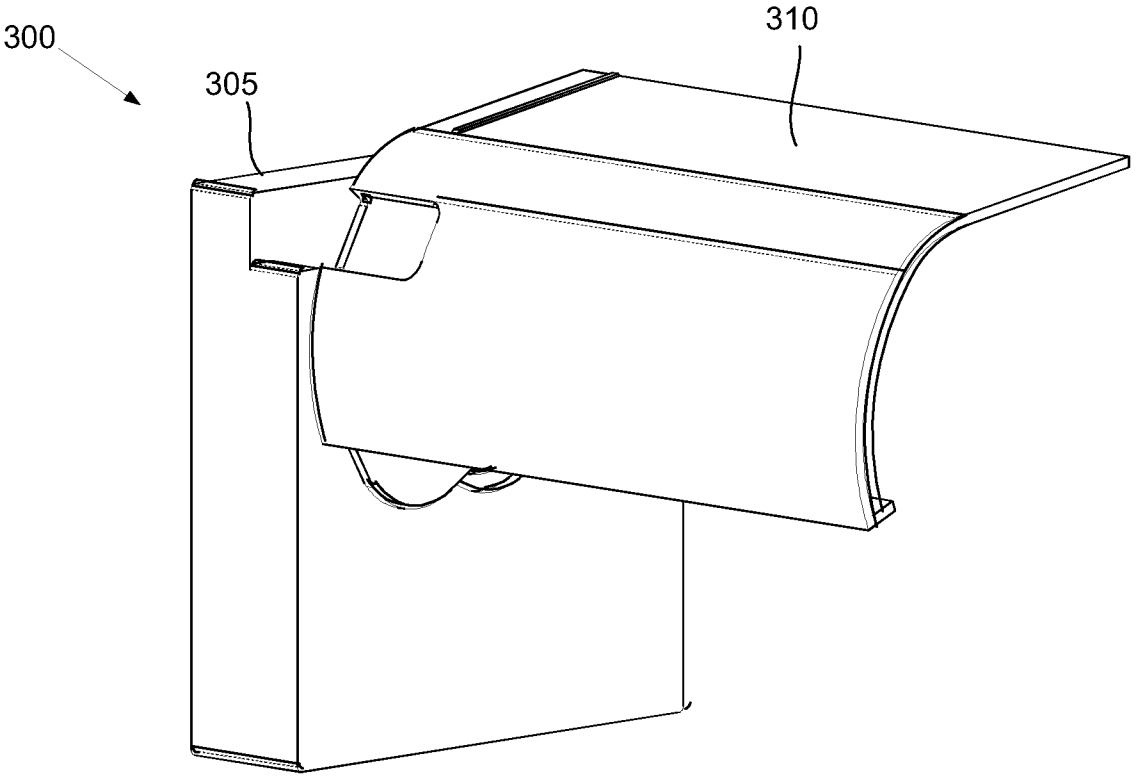

FIGS. 4A-4C are perspective views of the assembled bistable cover assembly (300). FIG. 4A shows the cover in its closed position with the pre-tensioned spring (315) entirely contained in the interior cavity (340) of the base (305). Three fasteners (325) are shown securing the components in place. A door can be fastened over the opening of the interior cavity (340) or the hinge assembly can be fastened against another component to completely enclose the spring (315). The spring (315) provides an upward force that biases the moving post (322, FIG. 3B) of the intermediate part (320, FIG. 3B) into the upper portions of the arc shaped aperture (330, FIG. 3B). This secures the cover (310) in its closed position but allows it to be moved by manual pressure that overcomes the spring bias.

FIG. 4B shows the cover (310) in its fully open position with the moving post (322, FIG. 3B) of the intermediate part (320, FIG. 3B) moved to the opposite end of the arc shaped aperture (330, FIG. 3B). The pre-tensioned torsion spring (315, FIG. 4A) also applies an upward bias force in this position that tends to push the moving post (322, FIG. 3B) into the upper end of the arc shaped aperture (330, FIG. 3B). This secures the cover (310) in its open position and allows the substrate roll (110, FIG. 1) to be replaced or inspected. FIG. 4C is another view of the cover (310) in its closed position. As discussed above, in this position the cover (310) protects the substrate roll (110, FIG. 1) and prevents outside objects from becoming caught in the substrate roll (110, FIG. 1) or other mechanisms beneath the cover (310).

The illustrative bistable cover assembly (300) has a number of advantages. First, the spring (315) is located in an enclosed space that is not normally accessible to the user during the operation of the printer. This prevents the user from accidentally becoming entangled with the spring (315) or releasing the spring (315). Second, if the spring (315) is accidentally released, it is at least partially contained within the cavity (340) of the base (305). These advantages increase the user's safety and the aesthetics of the printer.

This illustrative bistable cover mechanism (300) provides a number of assembly advantages. The hinge assembly (305, 315, 320, 325-1, 325-2, 325-3) can be separately assembled on a sub-assembly line that has specific tools and fixtures for safely and efficiently pre-tensioning and mounting the spring (315) and intermediate part (320) to the base (305). In this example, the assembly process is only performed once because the cover (310) can be attached or removed without disassembly of the hinge assembly. On the main production line or during maintenance, the cover (310) can be easily removed and reattached from the hinge assemblies. Attaching or removing the cover (310) does not involve releasing the tension from the spring or handling a pre-tensioned spring.

The systems and assemblies described above are only illustrative examples. A variety of alternative implementations could be used. For example, the hinge assembly (305, 315, 320, 325-1, 325-2, 325-3) could be used in either a bistable cover application or in a cover that is always preloaded in one direction. Hinge assemblies that always preload a cover in one direction can be used to hold a cover in a closed position.

Figure 5:
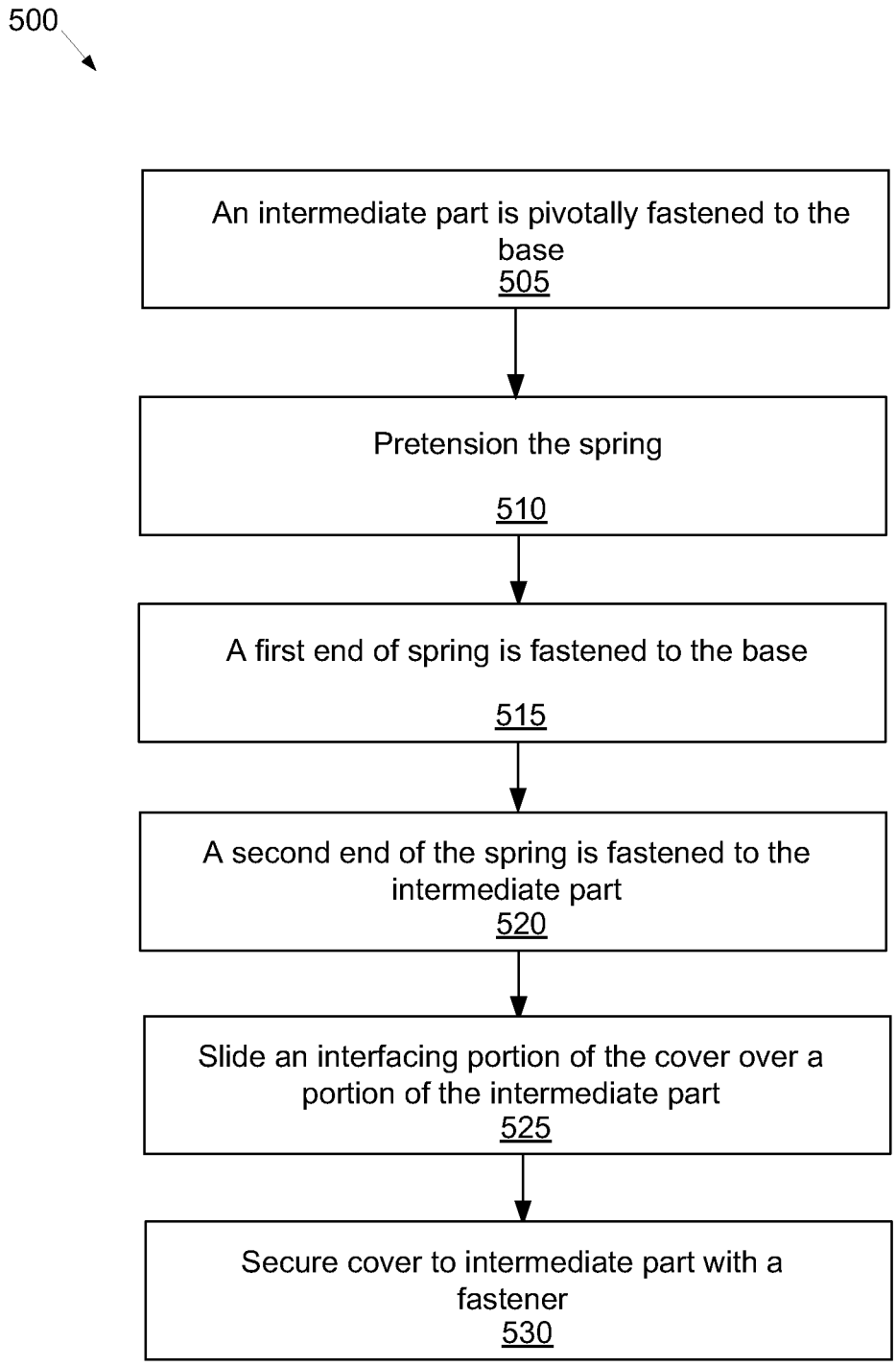
FIG. 5 is a flowchart showing one illustrative method for assembling a bistable cover assembly with a pre-tensioned spring, according to one example of principles described herein.

FIG. 5 is a flowchart showing one illustrative method (500) for assembling a bistable cover mechanism with a pre-tensioned spring. The intermediate part is pivotally fastened to the base (block 505). The spring is preloaded to a desired amount (block 510). A first end of the spring is fastened to the base (block 515) and a second end of the spring is fastened to the intermediate part (block 520). For example, where the intermediate part is an elongated lever, one end of the intermediate part may be fastened to the base and the opposite end may be attached to the spring. This completes the assembly of the hinge assembly. As long as the hinge assembly remains functional, there is no need for the hinge assembly to be taken apart or the spring exposed during the attachment or removal of the cover. The cover is attached by sliding an interfacing portion of the cover over the body of the intermediate part (block 525) and then securing the cover to the intermediate part with a fastener (block 530). Removal of the cover is performed by reversing the last two blocks. Specifically, the fasteners holding the cover to the intermediate devices are removed and the cover is slipped off from the intermediate devices.

The method described above is only one illustrative example and is not intended to be limiting. The blocks could be reordered, combined, eliminated or additional blocks could be added. For example, instead of pre-tensioning the spring, the spring may be tensioned when the second end of the spring is attached to the intermediate part. In some implementations the interfacing portion of the cover may include a compliant locking mechanism that eliminates the need for securing the cover to the intermediate part with fastener.

In conclusion, the illustrative bistable cover resolves long standing issues related to pre-tensioned springs. The bistable cover assembly contains a pre-tensioned spring within a base and uses an intermediate part between the spring and the cover. The intermediate part acts as an interface between the spring and the cover and allows the cover to be removed without removing the preload from the spring or detaching the spring from the base. This increases the ease of assembly, printer aesthetics, and ease of maintenance.

The preceding description has been presented only to illustrate and describe examples of the principles described herein. This description is not intended to be exhaustive or to limit these principles to any precise form disclosed. Many modifications and variations are possible in light of the above teaching.

What is claimed is:

1. A bistable cover assembly comprising:

a cover;

a base;

an intermediate part; and a pre-tensioned spring comprising a first end and a second end, the pre-tensioned spring being attached to the base and the intermediate part such that the pre-tensioned spring biases the intermediate part into two stable positions, the cover interfacing with the intermediate part and being closed in a first of the two stable positions and open in a second of the two stable positions, in which the base comprises an opening through which a portion of the intermediate part extends and the second end of the spring is attached to the portion of the intermediate part extending through the opening.

2. The assembly of claim 1, in which the spring is mounted in a cavity in the base.

3. The assembly of claim 1, in which the intermediate part comprises an elongated body, one end of the elongated body being pivotally connected to the base and a second end of the elongated body being attached to the second end of the spring.

4. The assembly of claim 1, in which the opening is an arc shaped opening, the spring biasing the intermediate part toward the ends of the arc shaped opening.

5. The assembly of claim 1, in which contact between the intermediate part and the opening limits the motion of the cover.

6. The assembly of claim 1, in which the cover comprises an interface portion for mating with the intermediate part such that torque is transmitted between the spring and the cover through the intermediate part.

7. The assembly of claim 1, in which a first bistable hinge mechanism is disposed at a first end of the cover and a second bistable hinge mechanism is disposed on an opposite end of the cover.

8. The assembly of claim 1, in which a body of the intermediate part extends from a surface of the base and an interface portion of the cover slips over the body of the intermediate part that extends from the surface of the base.

9. The assembly of claim 1, in which the cover covers a substrate roll on a printer.

10. The assembly of claim 1, in which the spring is torsional spring.

11. The assembly of claim 10, in which the spring is pre-tensioned such the spring exerts force on the intermediate part throughout a range of motion of the intermediate part.

12. A bistable cover assembly comprising:

a base comprising a cavity, an anchor point in an interior of the cavity and an aperture;

a torsional spring mounted in the cavity, a first end of the torsional spring being mounted to the anchor point;

an intermediate part comprising an elongated body, a first post extending from a first end of the elongated body and being pivotally connected to the base and a second post extending from a second end of the elongated body, the second post extending through the aperture in the base and being connected to a second end of the torsional spring; and a cover comprising interface portions disposed at opposing ends of the cover, in which an interface portion mates with the elongated body such that torque is transmitted between the spring and the cover through the intermediate part;

in which contact between the intermediate part and the aperture limits the motion of the cover, the torsional spring being pre-tensioned such that the torsional spring exerts force on the intermediate part throughout the motion of the intermediate part and biases the intermediate part into two stable positions, the cover interfacing with the intermediate part and being closed in a first of the two stable positions and open in a second of the two stable positions.

13. A method for assembling a bistable cover assembly comprising:

pivotally fastening an intermediate part to a base;

fastening a first end of a spring to the base;

fastening a second end of the spring to the intermediate part to form a hinge assembly;

attaching a cover by sliding a first interface portion of the cover over the intermediate part to mate the cover to the hinge assembly such that torque is transmitted between the spring and the cover through the intermediate part to bias the cover in two stable positions, the cover being closed in a first of the two stable positions and open in a second of the two stable positions; and limiting a range of motion of the intermediate part and mated cover through mechanical contact between the base and the intermediate part.

14. The method of claim 13, further comprising pre-tensioning the spring such that the spring exerts force on the intermediate part throughout the range of motion of the intermediate part.

15. The method of claim 13, further comprising securing the first interface portion of the cover with the intermediate part with a fastener.

16. The method of claim 13, further comprising mating a second interface portion of the cover to a second hinge assembly, the second interface portion being on an opposite end of the cover of the first interface portion.

* * * * *

UNITED STATES PATENT AND TRADEMARK OFFICE

CERTIFICATE OF CORRECTION

PATENT NO. : 8,523,010 B2
APPLICATION NO. : 13/149386
DATED : September 3, 2013
INVENTOR(S) : Josep Ortiz Mompel et al.

It is certified that error appears in the above-identified patent and that said Letters Patent is hereby corrected as shown below:

In the Specification

In column 3, line 14, delete “The” and insert -- This --, therefor.

In the Claims

In column 7, line 18, in Claim 11, after “such” insert -- that --.

Signed and Sealed this
Twelfth Day of November, 2013

Teresa Stanek Rea
*Deputy Director of the United States Patent and Trademark Office*